US006808436B1

(12) United States Patent
Siu

(10) Patent No.: US 6,808,436 B1
(45) Date of Patent: Oct. 26, 2004

(54) AERIAL TOY APPARATUS

(75) Inventor: Kong Wai Siu, Hong Kong (HK)

(73) Assignee: Alice Siu, Palo Alto, CA (US)

( * ) Notice: Subject to any disclaimer, the term of this patent is extended or adjusted under 35 U.S.C. 154(b) by 0 days.

(21) Appl. No.: 10/671,036

(22) Filed: Sep. 24, 2003

(51) Int. Cl.[7] ..... A63H 27/00

(52) U.S. Cl. ..... 446/231; 446/51; 446/176; 124/63; 124/70; 124/38

(58) Field of Search ..... 446/34, 51–54, 446/176, 180, 230, 231; 124/56, 63–65, 70, 26, 37, 38

(56) References Cited

U.S. PATENT DOCUMENTS 2,993,297 A * 7/1961 Bednar et al. ..... 446/197
3,077,876 A * 2/1963 Richeter ..... 124/65
3,091,052 A * 5/1963 Ryan ..... 446/212
3,301,246 A * 1/1967 Wolfe ..... 124/65
4,038,776 A * 8/1977 Filipeli ..... 446/52
4,084,820 A * 4/1978 Olson, Jr. ..... 473/511

* cited by examiner

*Primary Examiner*—Derris H. Banks
*Assistant Examiner*—Bena B. Miller
(74) *Attorney, Agent, or Firm*—Pacific Law Group LLP; Chi Ping Chang

(57) ABSTRACT

A aerial toy comprises a hollow sleeve member and a base member to receive and accommodate the hollow sleeve member longitudinally for sliding movement, the base member having a cap provided with a plurality of holes permit air entrance into the base member when it is pulled and an air insulation member bendably placed thereof inside the cap in a position opposite to the holes to prevent air exit from the base member when it is pushed to permit easy sliding of the base member along the hollow sleeve member while maintaining sufficient compressed air thereof. The aerial toy apparatus further comprises an air chamber into which the hollow sleeve member fits securely and a launch tube into which the air chamber fits securely to receive the compressed air from the hollow sleeve member and a flying member mountable onto an upper end of the launch tube to be pushed off of the apparatus by the compressed air released from the launch tube.

9 Claims, 2 Drawing Sheets

AERIAL TOY APPARATUS

FIELD OF THE INVENTION

This invention relates generally to aerial toys, and more specifically relates to a new and improved aerial toy apparatus that is safe for young children to handle, easy to move the pump member and mount the flying member onto the launch tube, while maintaining an ability to launch the flying member for a considerable distance.

BACKGROUND OF THE INVENTION

Toy apparatus capable of launching a flying member for a considerable flying distance has been popular with young children. The existing aerial pump toys usually use compressed air to power the launch of the flying member. However, they are generally disadvantaged by a variety of shortcomings. For instances, the launch members of the existing aerial pump toys are easy to cause injury to the operator's hand, as they are not provided with enough protective units around the handle positions. In addition, most of the flying members of the existing aerial pump toys are made of soft compressible foam without any built-in air insulation unit, which may cause air leakage from the foam loopholes to affect launch efficiency. Furthermore, the prior art aerial pump toys do not provide any air exit structure at the closed end of their pump members thereby causing difficulty for the young children to pull out the pump members due to the lack of differential air pressure between the inside and outside of the pump members. Lastly, the prior art aerial pump toys require that the flying member and the launch tube be kept substantially "tight fit", which requirement would cause considerable difficulty for the young children to mount the flying member onto the launch tube.

U.S. Pat. No. 6,568,985 to Brinkley discloses an aerial toy comprising a hollow sleeve portion, a base pump member and a lunch tube upon which a flying member is mounted. The flying member, however, must contain at least one constriction circumferentially positioned around the launch tube so as to provide a "tight fit" between the flying member and the launch tube to generate sufficient air pressure for launching. While U.S. Pat. No. 6,568,985 provides an aerial toy capable of flying a considerable distance, it does not provide solutions to one of more of the shortcomings described above.

There is a need for a new and improved aerial toy that is safe for young children to handle, easy to move the pump member and mount the flying member on the launch tube, while still being capable of flying a considerable distance.

SUMMARY OF THE INVENTION

Accordingly, this invention provides a new and improved aerial toy aimed to overcome the shortcomings of the prior art technology while improving it into a safe, interesting and easy-to-use aerial toy apparatus. The aerial toy apparatus comprises a hollow sleeve member, opening at both ends; a base member to receive and accommodate the hollow sleeve member longitudinally for sliding movement, the base member having a cap at a lower end wherein the cap has a plurality of holes at its outer surface to permit air entrance into the base member when the base member is moved backward and an air insulation member bendably placed at an inner surface of the cap in a position opposite to the holes to prevent air exit from the base member when the base member is moved forward such that the base member moves easily along the hollow sleeve member while maintaining sufficient compressed air thereof. The aerial toy apparatus further comprises an air chamber into which an upper end of the hollow sleeve member fits securely thereof; a launch tube into which an upper end of the air chamber fits securely to receive the compressed air from the hollow sleeve member, and a flying member having an internal opening at one end mountable onto an upper end of the launch tube to be pushed off of the apparatus by the compressed air released from the launch tube. The air chamber of the aerial toy apparatus further comprises a sheath located on a portion of the air chamber to provide safe use of the toy apparatus. The base member further comprises a circle construction at its upper end to protect the base member from frequent collision with the air chamber so as to make the toy apparatus more durable. A layer of blank paper may be optionally wrapped inside the base member to prevent air leakage. One or more circle shaped films are provided inside an internal portion of the flying member to prevent air leakage from the soft material from which the flying member is made.

BRIEF DESCRIPTION OF THE DRAWING

The current invention will be better understood and the nature of the objects set forth above will become apparent when consideration is given to the following detailed description of the preferred embodiments. For clarity of explanation, the detailed description further makes reference to the attached drawing herein.

BEST MODE FOR CARRYING OUT THE INVENTION

Figure 1:
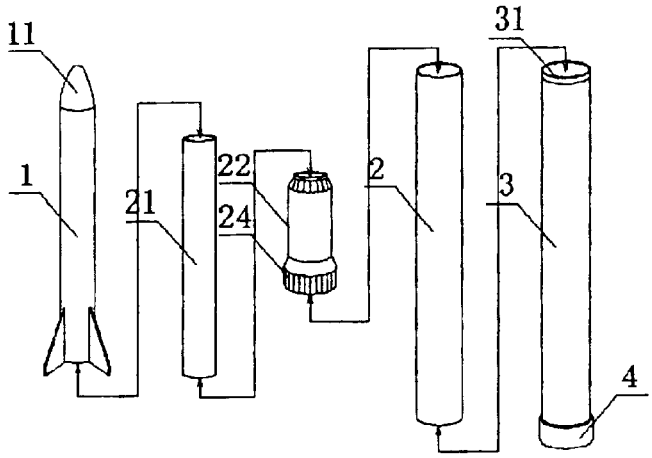
FIG. 1 is an exploded view of the construction of the aerial toy apparatus according to the invention.

Referring now in detail to FIG. 1, there is shown one embodiment of the aerial toy apparatus according to the invention. The aerial toy apparatus comprises primarily five parts, a flying member 1, a hollow sleeve member 2, a base member 3, an air chamber 22, and a launch tube 21. The hollow sleeve member 2 is in a form of an elongated cylindrical tube having two open ends with a upper end connected to the air chamber 22 and a lower end connected to the base member 3 in such manner that the hollow sleeve 2 slidably fits into the base member 3. The hollow sleeve member 2 as shown in the embodiment has a length of about 21 cm and a diameter of about 5 cm. It should be noted, however, that the length and diameter of the hollow sleeve 2 could be varied according to the overall dimensions desirable for the apparatus from time to time.

Figure 3:
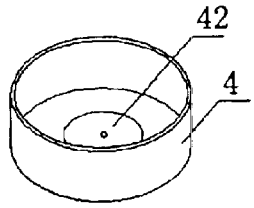
FIG. 3 is the view of the inner surface of the cap at the end of the base member.
Figure 4:
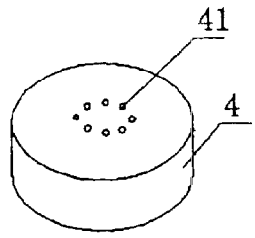
FIG. 4 is the view of the outer surface of the cap at the end of the base member.

Referring jointly to FIG. 1 and FIGS. 3–4, the base member 3 is shown as an elongated cylindrical tube with a dimension sufficient to receive and accommodate the hollow sleeve 2 so that the base member 3 can move slidably along the length of the hollow sleeve 2. The base member 3 has a cap 4 at one end wherein the outer surface of the cap 4 is provided with a plurality of holes 41 to permit the entry of air into the base member 3 when the base member 3 is moved along the hollow sleeve 2 in a backward direction. Accordingly, the base member 3, contrary to the prior art aerial toy apparatus, is not absolutely sealed and closed at the capped end. Instead, a reasonable amount of air can be drawn into the base member 3 from the capped end through the plurality of holes 41. Additionally, as shown in FIG. 3, a rubber piece 42 is provided at the inner surface of the cap 4, at a position opposite to the location of the holes 41, to act as an air insulator to prevent air leakage when the base member 3 is moving along the hollow sleeve 2 in a forward direction. The rubber piece 42 on the cap 4 is not completely glued on the cap. Rather, the rubber piece 42 is actually placed on a small knob (not shown) against the inner surface of the cap 4. Since the rubber piece 42 is just placed on the knob, it can be actually turned and rotated around the knob in response to an externally applied force such as air pressure or one's finger. When the base member 3 is pulled or extended, air rushes into the hollow sleeve 2 through the holes 41 on the cap 4. The air is able to rush through the holes 41 because the rubber piece 42 is bendable or movable. Thus, when the base member 3 is extended backward, air rushes through the holes 41 and around the edges of the bendable/movable rubber piece 42 into the hollow sleeve 2. When the base member 3 is pushed to shoot the flying member 1, air is pushed forward to the compression chamber. Since air is being pushed forward, the bendable/movable rubber piece 42 is pushed against the cap 4 and thus air is unable or otherwise being prevented to leak through the holes 41.

It is conceivable that the rubber piece 42 can be alternatively replaced by or with any material that can provide similar air insulation function to the cap 4. The base member 3 as shown in the embodiment has a dimension sufficient to receive and accommodate the hollow sleeve member 2. Preferably, the diameter of the base member 3 is about 50–5.5 cm in diameter. The cap 4 as shown is preferably has a length of 2 cm and diameter of 5.5 cm. It should be noted, however, that the length and diameter of the base member 3 and the cap 4 could be varied according to the overall dimensions desirable for the apparatus from time to time.

The base member 3 according to the invention, therefore, can not only ensure the successful transmission of the air within the internal opening of the hollow sleeve member 2 due to the presence of the cap having the arrangement of holes 41 on one side and a rubber piece 42 on the opposite side, but also facilitates a very easy and smooth movement for the base member 3 along the hollow sleeve member 2 by keeping the air pressure inside the base member 3 at the same level as of outside. In addition, as stated above, when the base member 3 is pushed to compress the air inside it, the rubber piece 42 can prevent air from leaking through the holes 41 and, as a consequence, the difficulty to compress the air has being significantly reduced to match the operator who are young children. Referring back to FIG. 1, there is shown a circle construction 31 at the opposite end of cap 4 of the base member 3, which is in a position facing constant contacts and collision with the air chamber 22 when the base member 3 is moving forward along the hollow sleeve 2. The circle construction 31 is therefore provided to endure frequent collision to make the toy apparatus more durable. To insure the operation effect of the toy, the inside of the base member 3 is optionally wrapped with a 250 g/m blank paper (not shown) to reduce the gap between the base member 3 and the hollow sleeve member 2 so as to prevent any potential air leak thereof. While the dimension of the circle construction 31 may be varied according to the overall desirable dimensions of toy apparatus from time to time, the circle construction 31 in the embodiment shown has a length of 2 cm and diameter of 5.5 cm.

Figure 2:
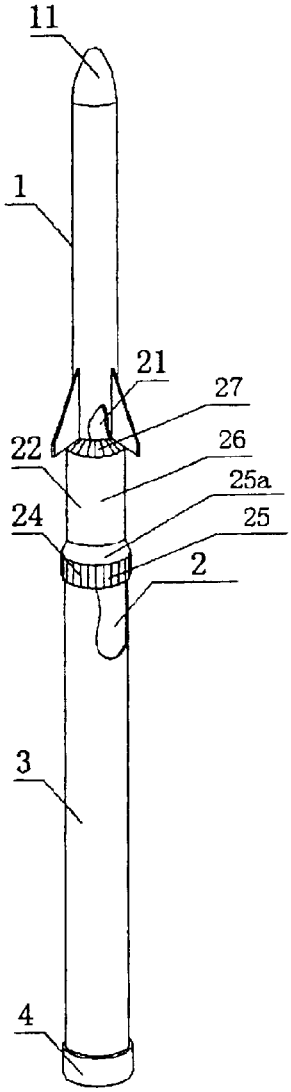
FIG. 2 shows the installation of FIG. 1.

Referring jointly to FIGS. 1 and 2, the air chamber 22 is positioned between the hollow sleeve 2 and the launch tube 21. The air chamber 22 includes a first portion 25, a second portion 26 and a third portion 27 in which the first portion 25 has a diameter sufficient to receive and accommodate a portion of the upper end (not shown) of the hollow sleeve 2 such that the hollow sleeve 2 can be inserted and securely fitted into a tapered portion 25*a* of the first portion 25. The diameter of the first portion 25 of the embodiment as shown is about 6 cm which is slightly reduced near the tapered portion 25*a* to ensure tight installment of the hollow sleeve 2. To safeguard the use of the toy apparatus, a sheath 24 is provided near the first portion 25 to prevent any potential injury to the operator caused by quickly pushing of the base member 3. The third portion 27 of the air chamber 22 is tapered away from the second portion 26 and has a dimension sufficient to receive and accommodate the launch tube 21. In the embodiment shown, the launch tube 21 has a diameter around 2.75 cm while the third portion 27 has a diameter around 2.75 to 3.0 cm so that the launch tube 21 can be easily and securely mounted on the third portion 27 of the air chamber 22. While the air chamber may be in a variety of sizes or dimensions, yet a preferred ratio of the diameters between the hollow sleeve 2 and the second portion 26 of the air chamber 22 is around 1:2 such that the volume of hollow sleeve 2 is larger than the volume of air chamber, which is slightly larger than that of the launch tube 21. Such arrangement enables the toy apparatus to compress more air into a larger volume first following by pushing such air instantly into a smaller volume to produce stronger launch power. Consequently, the flying member according to the invention is able to fly a considerable distance without the necessity of maintaining key elements of the toy apparatus in a substantial "air tight" or "tight fit" condition before the launch.

While the embodiments as shown separate the hollow sleeve 2, the air chamber 22 and the launch tube 21 into distinct parts. It should be noted that they can be constructed as an integral part of the toy apparatus to be connected to the base member 3 while maintaining the same functions as described above. While the hollow sleeve 2, the base member 3, the air chamber 22 and the launch tube 21 as shown in the embodiments are made from plastics, it is understood that they could be made from other materials as well.

Figure 5:
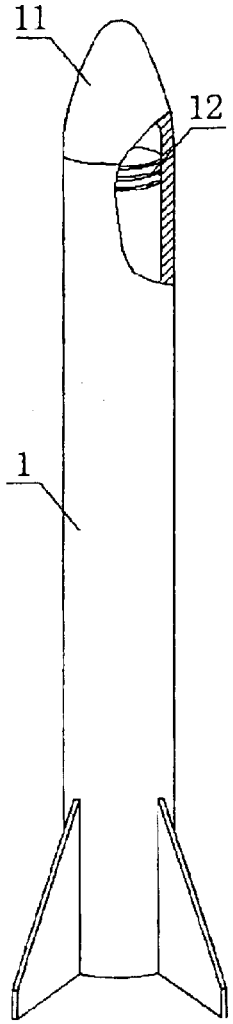
FIG. 5 is the elevational, partially cut-way view of the flying member.

Referring to FIG. 5, the flying member 1 is viewed as an elongated hollow object having a nose section 11 with an extended pointed end at a distal end and an open end to be mounted onto the launch tube 21. Because the flying member 1 is usually made by some soft material having porous loopholes thereof, it is easily deformed to cause air leakage thereby failing to reach the best conditions. To minimize such disadvantage, one or more circular shape films 12 are provided inside the internal portion of the nose section 11 to prevent any air leakage caused therefrom. The number of these films is according to the operations. It should be noted that the reminding portion of elongated flying member is not required to be made from compressible foam material according to the invention, as the requirement of maintaining the flying member 1 and the launch tube 21 in an "air tightness" condition, which is a prerequisite of the prior art aerial toy, for longer flight is not a prerequisite condition for the invention. Rather, flying member 1 may be made from some harder materials for easy mounting. In this regards, to ensure the safe use of the toy apparatus, a soft warhead is provided to the nose portion 11 in order to buffer the collision when it flies out so as to prevent it from causing any damage to human, animals or some other objects. While the flying member 1 in the embodiment as shown is in a configuration of rocket, it should be noted that the flying member 1 can be in many different configurations and shapes.

Figure 6:
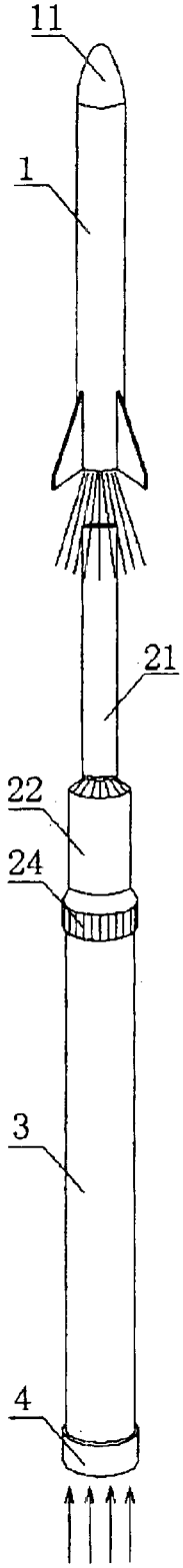
FIG. 6 is the view of the toy under the operating mode.

Referring now to FIG. 6, when carrying out the invention as in FIG. 5, the operator should mount flying member 1 onto the upper end of the launch tube 21, while moving the base member 3 backward along the hollow sleeve member 2 to a position sufficient to draw enough air inside thereof, but at no event, to a position where the base member 3 is moving out of the hollow sleeve member 2. Then, pushing the base member 3 forward rapidly to compress the air in the base member 3 and the hollow sleeve member 2 into the air chamber 22, which will push the accumulated air instantly and simultaneously to the launch tube 21 to blast off the flying member 1. As a result, the flying member 1 will be launched out for a considerable distance by the pushing power of the compressed air.

In summary, the aerial toy apparatus according to the present invention provides the following significant advantages over the prior art aerial toy or technology existed: (1) The toy is easier to operate and more interesting for young children because the inclusion of the holes 41 and the rubber piece 42 to the cap 4; (2) The larger diameter of the hollow sleeve member 2, comparing to that of the launch tube 21 and the inclusion of the air chamber 22 therebetween, effectively increases the pushing power of the compressed air; (3) The sheath 24 insures the safe use of the toy apparatus; (4) The circle construction 31 at the end of the base member 3 protects the base member 3 from frequent collision with the air chamber 22 to make the toy apparatus more durable; (5) The blank paper wrapped inside the base member 3 can prevent the leak of the air; and (6) The circle shaped films 12 inside the flying member can prevent the any potential leak of the air.

Thus, it is to be understood that the scope of the invention is not limited to the disclosed embodiments. On the contrary, it is intended to cover various modifications and similar arrangements based upon the same operating principle and method. The scope of the claims, therefore, should be accorded the broadest interpretations so as to encompass all such modifications and similar arrangements.

What is claimed is:

1. An aerial toy apparatus, comprising:

a hollow sleeve member, having an opening at both ends;

a base member to receive and accommodate the hollow sleeve member longitudinally for sliding movement, the base member having a cap at a lower end wherein the cap has a plurality of holes at its outer surface to permit air entrance into the base member when the base member is moved backward and an air insulation member bendably placed at an inner surface of the cap in a position opposite to the holes to prevent air exit from the base member when the base member is moved forward such that the base member moves easily along the hollow sleeve member while maintaining sufficient compressed air thereof;

an air chamber into which an upper end of the hollow sleeve member fits securely;

a launch tube into which an upper end of the air chamber fits securely to receive the compressed air from the hollow sleeve member; and a flying member having an internal opening at one end mountable onto an upper end of the launch tube to be pushed off of the apparatus by the compressed air released from the launch tube.

2. The aerial toy apparatus of claim 1 wherein the air insulation member is a rubber piece.

3. The aerial toy apparatus of claim 1 wherein the air chamber further comprises a sheath located on a portion of the air chamber to provide safe use of the toy apparatus.

4. The aerial toy apparatus of claim 1 wherein the ratio of the internal diameters of the hollow sleeve member and the launch tube is around 2:1.

5. The aerial toy apparatus of claim 1 wherein the base member further comprises a circle construction at its upper end to protect the base member from frequent collision with the air chamber so as to make the toy apparatus more durable.

6. The aerial toy apparatus of claim 1 wherein the base member further comprises a layer of blank paper wrapped inside the base member to prevent air leakage.

7. The aerial toy apparatus of claim 1 wherein the flying member includes a soft warhead extended from an upper end of the flying member.

8. The aerial toy apparatus of claim 7 wherein the flying member further comprises one or more circle shaped films inside an internal portion of the flying member to prevent air leakage.

9. The aerial toy apparatus of claim 1 wherein the hollow sleeve member, the air chamber and the launch tube are sequentially formed as an integral part upon which the flying member is mounted.

* * * * *